US010781661B2

(12) United States Patent
Tanguy et al.

(10) Patent No.: US 10,781,661 B2
(45) Date of Patent: Sep. 22, 2020

(54) ISOLATION DEVICE FOR A WELL WITH A BREAKING DISC

(71) Applicant: Saltel Industries, Bruz (FR)

(72) Inventors: Gwenaël Tanguy, Pace (FR); Samuel Roselier, Le Rheu (FR); Jean-Louis Saltel, Le Rheu (FR); Romain Neveu, Saint Senoux (FR); Julie Leduc, Bruz (FR)

(73) Assignee: Saltel Industries (FR)

( * ) Notice: Subject to any disclaimer, the term of this patent is extended or adjusted under 35 U.S.C. 154(b) by 107 days.

(21) Appl. No.: 15/744,523

(22) PCT Filed: Jul. 15, 2016

(86) PCT No.: PCT/EP2016/066937
§ 371 (c)(1),
(2) Date: Jan. 12, 2018

(87) PCT Pub. No.: WO2017/009460
PCT Pub. Date: Jan. 19, 2017

(65) Prior Publication Data

US 2018/0202259 A1 Jul. 19, 2018

(30) Foreign Application Priority Data

Jul. 15, 2015 (FR) ..... 15 01488

(51) Int. Cl.
*E21B 33/12* (2006.01)
*E21B 34/06* (2006.01)
(Continued)

(52) U.S. Cl.
CPC ..... *E21B 34/063* (2013.01); *E21B 23/06* (2013.01); *E21B 33/127* (2013.01)

(58) Field of Classification Search
CPC ..... E21B 34/063; E21B 23/06; E21B 33/127
See application file for complete search history.

(56) References Cited

U.S. PATENT DOCUMENTS 2,906,342 A 9/1959 Russell et al.
5,400,855 A 3/1995 Stepp et al.
(Continued)

FOREIGN PATENT DOCUMENTS

EP 3020912 A1 5/2016
FR 2922586 A1 4/2009
(Continued)

OTHER PUBLICATIONS

French Search Report for Application No. 1501488 dated Jun. 1, 2016.
(Continued)

*Primary Examiner* — Nicole Coy
*Assistant Examiner* — Yanick A Akaragwe
(74) *Attorney, Agent, or Firm* — Lerner, David, Littenberg, Krumholz & Mentlik, LLP

(57) ABSTRACT

The invention relates to a fluid control device (500) for treating a well, said device comprising:

a piston (550) translatably mounted in said chamber (320) and releasable immobilization means (900) capable of rupturing, on which, in an initial state, one end (552) of the piston (550) comes into abutment and which, in an initial position, close the pipe associated with the annular space (350), the immobilization means (900) being releasable under the influence of the fluid pressure in the chamber (320) which is equal to the fluid pressure in the liner (100), a closure member (514) translatably mounted in said chamber (320), configured to open or close the communication pipe (316) with the inside of the casing (200), said closure member being, in the initial state, in contact with another end (554) of the piston (550) which holds it in the open position.

20 Claims, 11 Drawing Sheets

(51) Int. Cl.
*E21B 33/127* (2006.01)
*E21B 23/06* (2006.01)

(56) References Cited

U.S. PATENT DOCUMENTS

| | | | | |
|---|---|---|---|---|
| 7,077,195 | B2 * | 7/2006 | Zotta | E21D 20/02 138/93 |
| 7,377,333 | B1 * | 5/2008 | Sugiura | E21B 7/06 166/66.5 |
| 2005/0230122 | A1 * | 10/2005 | Cho | E21B 23/04 166/381 |
| 2014/0190683 | A1 * | 7/2014 | Hallunbaek et al. | E21B 33/1285 166/122 |
| 2017/0321515 | A1 * | 11/2017 | St Hr | E21B 34/063 |

FOREIGN PATENT DOCUMENTS

| | | | |
|---|---|---|---|
| WO | 2014154480 | A1 | 10/2014 |
| WO | 2015104381 | A1 | 7/2015 |

OTHER PUBLICATIONS

International Search Report from PCT/EP2016/066937, dated Oct. 24, 2016.

* cited by examiner

ISOLATION DEVICE FOR A WELL WITH A BREAKING DISC

CROSS REFERENCE TO RELATED APPLICATIONS

The present application is a national phase entry under 35 U.S.C. § 371 of International Application No. PCT/EP2016/066937 filed Jul. 15, 2016, published in French, which claims priority from French Patent Application No. 1501488 filed Jul. 15, 2015, all of which are incorporated herein by reference.

FIELD OF THE INVENTION

The present invention relates to a device for controlling and isolating a tool, in the form of an expanding liner for treating a well or a pipe, this tool being connected to a casing feeding a fluid under pressure and being interposed between said casing and the wall of said well or of the pipe.

Expressed differently, it relates to a downhole system allowing the isolation of the upstream space from the downstream space of an annular region comprised between a casing and the formation (in other words subsurface rocks) or between the same casing and the inner diameter of another casing already present in the well. This isolation must be accomplished while still preserving the integrity of the entire casing string, i.e. to say the steel column comprised between the formation and the well head.

It will be noted that it is necessary to distinguish the integrity of the annular space and the integrity of the casing, both being essential to the integrity of the well.

The annular space previously mentioned is generally sealed by using a cement which is pumped in liquid form into the casing from the surface, then injected into the annular space. After injection, the cement hardens and the annular space is sealed.

The quality of the cementation of this annular space assumes a very great importance for the integrity of the well.

In fact, this sealing protects the casing from the salt water zones contained underground, which can corrode and damage them and possibly bring about the loss of the well.

Moreover, this cementation protects the aquifers from pollution that could occur from nearby formations containing hydrocarbons.

This cementation constitutes a barrier protecting from the risks of eruption caused by gas at high pressure which can migrate into the annular space between the formation and the casing.

In practice, there are numerous reasons which can lead to an imperfect cementation process, such as the large size of a well, its horizontal zones, difficult circulation or loss zones. The result is poor sealing.

It will also be noted that wells are deeper and deeper, that a good number of them are drilled "offshore" above water depths which can reach more than 2000 m, and that the latest hydraulic fracturing technologies in which pressures can reach more than 15,000 psi (1000 bars) subject these sealed annular zones to very high forces.

From the preceding, it is clear that the cementation of the annular space(s) is particularly important and any weakness in its accomplishment, when the pressures in question are very high (several hundred bars), can cause damage which can lead to the loss of the well and/or cause considerable ecological damage.

The pressures in question can come from:

the inside of the casing toward the outside, i.e. from inside the well toward the annular space;

the annular space toward the inside of the casing.

The casing (or casing string), the length whereof can attain several thousand meters, consist of casing tubes, with unit lengths comprised between 10 and 12 m, assembled to one another by sealed threads.

The nature and the thickness of the material constituting the casing are calculated to withstand very high inner bursting pressures or outer collapsing pressures.

Moreover, the casing must be sealed throughout the duration of the life of the well, i.e. during several decades. Any detection of a leak leads systematically to repair or abandonment of the well.

Technical solutions are currently available to accomplish sealing of said annular space.

PRIOR ART

Numerous isolation systems have already been proposed and are current used for this purpose.

Document U.S. Pat. No. 7,571,765 describes a system comprising a rubber ring compressed and expanded radially by hydraulic pressure via a piston, to come into contact with the wall of the well. In use, however, these systems do not allow sealing a well having a section that is not a cylinder of revolution and are very sensitive to variations in temperature.

Mechanical isolation systems have been proposed based on swellable elastomers made of a polymer of the rubber type activated into swelling by contact with a fluid (oil, water or other, depending on the formulations). To avoid blockage of the tube during insertion down the well, the swelling must be relatively slow and may sometimes require several weeks for the isolation of the zone to be effective.

Other types of isolation systems are made of an expandable metal liner deformed by the application of liquid under pressure (see article SPE 22 858 "Analytical and Experimental Evaluation of Expanded Metal Packers For Well Completion Services (D. S. Dreesen et al—1991), U.S. Pat. Nos. 6,640,893, 7,306,033, 7,591,321, EP 2 206 879, EP 2 435 656).

Shown schematically is the general structure of a known system of this type in the appended FIGS. 1 and 2.

As can be seen in FIG. 1, to create an annular isolation system intended for sealingly isolating two adjoining annular spaces, referred to as EA1 and EA2, of a well or formation, the wall whereof is referred to as P, one known technique consists of positioning a deformable ductile membrane 10 of cylindrical geometry around a casing 20 at the desired position.

The membrane 10 is attached and sealed at its ends on the surface of the casing 20. A liner in the form of a ring between the outer surface of the casing 20 and the inner surface of the membrane 10 is thus defined. The inside of the casing 20 and the inner volume of the liner formed by the membrane 10 communicate with one another through a passage 22 passing through the wall of the casing 20.

The membrane 10 is then expanded radially toward the outside until it is in contact with the wall P of the well, as can be seen in FIG. 2, by increasing the pressure P1 in the casing 20. The membrane 10 forms a seal on this wall P, and the two annular spaces EA1 and EA2 defined between the wall P and the formation and the wall of the casing 20 are then isolated.

The membrane 10 can be made of metal or out of elastomers, reinforced with fibers or not.

Although they have already led to much research, systems of the type illustrated in appended FIGS. 1 and 2 have several disadvantages.

If the membrane 10 is made of elastomers and the circulation of the inflating fluid is accomplished without a valve in the passage 22, the membrane resumes a shape near to its initial state if pressure is released inside the casing after having inflated it. The membrane 10 then no longer serves to isolate the annular space.

If the membrane 10 is metallic and the circulation of the inflating fluid between the inside of the membrane 10 and the inside of the casing 20 is accomplished directly, once permanently deformed, the membrane 10 retains in principle its shape, and its function as a barrier in the annular space is also retained when the pressure in the casing 20 is released. If, however, the pressure increases in the annular space, on the side EA1 for example, the pressure differential between EA1 and the inside of the membrane 10 can be sufficient to collapse the metallic membrane 10. This will then no longer retain its role of isolating the annular space.

To avoid this, in the case of a membrane 10 made of metal or elastomers, the opening 22 allowing the circulation of the inflating fluid between the inside of the casing 20 and the inside of the membrane 10 can be provided with a non-return valve. This valve traps the inflating volume under pressure inside the membrane 10 at the conclusion of inflation. Nevertheless, if the temperature and/or the pressure in the annular space change, the volume inside the membrane can also change. If the pressure decreases, the membrane 10 can collapse or lose its sealing contact with the wall P of the well. The function of isolation of the annular space is then no longer ensured. If, on the other hand, the pressure increases, the membrane 10 can deform to the breaking point. If the membrane 10 does not break, there is a risk that the pressure will increase enough inside the membrane 10 to collapse the wall of the casing 20.

To avoid this risk there has been proposed, for example in document US 2003/0183398, in addition to the first opening 22 provided with a non-return valve, a second opening provided between the membrane 10 and the high pressure zone EA1, which incorporates a valve. The latter allows creation of an opening between the inside of the membrane 10 and the high pressure zone EA1 at the conclusion of inflation. In this manner, the changes in the temperature of the well or of the pressure on the side EA1 no longer have an effect on the pressure inside the membrane 10 because the membrane 10 is in communication with the annular space.

During inflation, the pipes are held open using rupturing pins which are configured to yield when a limiting value of shear is attained.

Nevertheless, these rupturing pins have reliability problems. Document SPE-169190-MS (*Improved Zonal Isolation in Open Hole Applications,* 2014) gives dimensions comprised between 1.15 and 1.30 mm for breaking pressures comprised between 4500 and 6800 psi (310 and 470 bars). The diameter of the pins is therefore very small, thus creating technical difficulties in manufacture. In addition, it is noted that, for a given value, important dispersions are observed (for example, for 1.19 mm pin, breaking pressures of the samples tested extend from 4600 to 5100 psi (320 to 350 bars)).

Due to their relatively small dimensions (on the order of a millimeter), it has thus proven difficult to obtain pins for which the breaking pressure is known with precision.

OBJECT OF THE INVENTION

The goal of the invention is to propose a device that makes it possible to resolve the aforementioned problems.

The invention proposes a fluid control device for treating a well, comprising an expandable liner placed on a casing and an assembly adapted to control the feeding of the inner volume of the liner using a fluid under pressure coming from the casing through a passage passing through the wall of the casing, to expand the liner radially outward, the assembly comprising a valve, said valve comprising:

- a body which defines a chamber into which lead
  - a communication pipe associated with the inside of the casing,
  - a pipe associated with the inside of the expandable liner and
  - a pipe associated with the annular space located outside the casing, said pipe being located in the extension of the chamber,
- a piston translatably mounted in said chamber and
- releasable immobilization means which can break, on which, in an initial state, one end of the piston comes into abutment and which, in an initial position, close the pipe associated with the annular space, the immobilization means being releasable under the influence of the pressure of the fluid in the chamber which is equal to the pressure of the fluid in the liner,
- a closure member translatably mounted in said chamber, configured to open or close the communication pipe with the inside of the casing, said closure member being, in the initial state, in contact with another end of the piston which holds it in the open position,
- so that, in the initial state, the piston allows only communication between the pipes associated with the inside of the casing and the inside of the expandable liner,
- then, after breaking of the releasable immobilization means, the piston is released in translation through the releasable immobilization means,
- so that, in the final state the pipe associated with the annular space located outside the casing is open and the closure member is no longer held in the open position by the piston.

Thanks to this device, it is possible to dispense with the use of a breaking pin thanks to a disc configured to hold the piston and also to break under the influence of the pressure of the fluid.

The use of the disc that breaks under the influence of the pressure in the chamber (and therefore in the inner volume of the liner) allows good precision, while still retaining the abutment role of the rupturing pin of the prior art.

The device can comprise the following features, taken alone or in combination:

- The device also comprises a spring which drives the closure member into the closing position to close the communication pipe with the inside of the casing when the immobilization means are broken,
- the device further comprising a measurement system configured to measure the position of the piston in said chamber, so that it is possible to know the state of the device,
- the measuring system comprises a magnet located in the piston and a sensor located in the housing, said sensor being capable of measuring a displacement of said magnet.

In addition, this device is advantageously inserted into a double back to back non-return valve system which prevents, once inflation is concluded, any communication between the inside of the casing and the liner and which allows communication of the liner with the annular space.

For this purpose, the invention proposes an isolation system for treating a well, comprising a device as previously described and characterized by the fact that said assembly comprises a non-return valve placed in a passage which connects the inner volume of the casing to the inner volume of the liner, said fluid control device and said non-return valve forming, after switching, two valves mounted in series and with opposite directions in the passage connecting the inner volumes of the casing and the liner.

The system can comprise the following characteristics, taken alone or in combination:

- the non-return valve placed in the passage connecting the inner volume of the casing to the inner volume of the liner is a valve biased elastically to closure, which opens under a fluid pressure which is exerted in the direction running from the inner volume of the casing to the inner volume of the liner.
- the valves are non-return valves in which a metal closure member rests on a metal seat,
- the valves are non-return valves with a conical seat,
- the valves comprise a seal adapted to rest against a complementary bearing when the valve is in its closing position or near its closing position,
- the seal is provided on the closure member and is adapted to rest against a complementary bearing formed on the body housing the valve and forming the seat, or is provided on the body housing the valve and forming a seat and is adapted to come into contact against a complementary bearing formed on the closure member,
- the non-return valve placed in the passage which connects the inner volume of the casing to the inner volume of the liner and the device are formed from two distinct sub-assemblies,
- the non-return valve placed in the passage which connects the inner volume of the liner and the device are placed in distinct parallel longitudinal channels formed in the body of the assembly.

The invention also proposes an assembly comprising in combination a non-return valve and a device as described previously, forming, after switching, two valves mounted in series and with opposite directions, back to back, on the passage connecting the inner volumes of a casing and a liner of a well isolation device.

The valves can be non-return valves in which a metal closure member rests on a conical metal seat.

Finally, the invention proposes a method for isolating two annular zones of a well, implementing a step of feeding an expandable liner placed on a casing using a fluid under pressure coming from the casing, to expand the liner radially outward, characterized by the fact that it comprises the steps of feeding the inner volume of the expandable liner by means of a non-return valve placed in a passage which connects the inner volume of the casing to the inner volume of the liner, then carrying out the switching of a system as previously defined between an initial state in which a connection is established between the inner volume of the casing and the inner volume of the liner to expand said liner and a final state in which the connection between the inner volume of the casing and the inner volume of the liner is interrupted and a connection is established between the inner volume of the liner and an annular volume of the well outside of the liner and of the casing, said device and said non-return valve forming, after switching, two valves mounted in series and with opposite directions on the passage connecting the inner volumes of the casing and the liner.

PRESENTATION OF THE FIGURES

Other features, aims and advantages of the present invention will appear upon reading the detailed description which follows, and with respect to the appended drawings, given by way of non-limiting examples and in which:

FIGS. 1 and 2 described previously show an annular isolation device conforming to the prior art, respectively before and after expansion of the expandable liner, FIGS. 3, 4 and 5 show a device conforming to the present invention respectively at the initial state, in the expansion phase of the expandable liner by communication between the inner volume of the casing and the inner volume of the liner, then in the final sealed state after switching of the three-way valve providing the connection between the inner volume of the liner and the annular volume of the well outside of the liner and of the casing.

FIGS. 6 and 7 show schematically an assembly conforming to a first variant embodiment of the present invention comprising, in combination, a three-way valve and a non-return valve at the input, respectively at the initial position and in the final switched position, FIG. 8 shows the equivalent schematic of the switched assembly illustrated in FIG. 7, FIG. 9 shows an axial section view running through a channel which houses an input valve, FIGS. 10 to 12 show a more general embodiment of the invention FIG. 13 illustrates a head-to-tail assembly of two insulation devices conforming to one embodiment of the invention, on a casing, to guarantee isolation between two adjoining annular zones of a well, whatever changes occur relating to pressure in the two annular zones, FIGS. 14 through 16 show a more general embodiment of the invention, FIGS. 17 and 18 show an embodiment of the invention with a system for measuring the displacements of the piston.

DETAILED DESCRIPTION OF THE INVENTION

The device that is the object of the invention finds application in a particular system of valves which will be described in detail as an illustration. Nevertheless, said device can be inserted into other types of systems, possessing other features. It will be described below.

An isolation system conforming to the present invention is observed in the appended FIG. 3, comprising an expandable liner 100 placed on a casing 200, facing a passage 222 passing through the wall of the casing 200 and an assembly 300 adapted to control the expansion of the liner 100. The assembly 300 comprises an input non-return valve 400 and a three-way valve 500 adapted to be switched once and forming, after switching, in combination with the input valve 400, two non-return valves mounted in series and with opposite directions on a passage connecting the inner volume 202 of the casing 200 and the inner volume 102 of the liner 100.

The liner 100 is advantageously formed from a cylinder of revolution metal envelope engaged on the outside of the casing 200 and of which the two axial ends 110, 112 are sealingly connected to the outer surface of the casing 200 at its two axial ends 110 and 112.

Once the isolation system thus formed is introduced into a well P so that the liner 100 is placed between two zones EA1 and EA2 to be isolated, the assembly 300 is adapted to initially ensure the feeding of the inner volume 102 of the liner 100 using a fluid under pressure coming from the casing 200, through the passage 222 passing through the wall of the casing 200, to radially expand the liner 100 outward as can be seen in FIG. 4.

More precisely, according to the invention, said assembly 300 comprises a non-return valve 400 placed in the passage 222 which connects the inner volume 202 of the casing 200 to the inner volume 102 of the liner 100 and means 500 forming a three-way valve adapted to be switched only once between an initial state corresponding to FIG. 4, wherein a connection is established between the inner volume 202 of the casing 200 and the inner volume 102 of the liner 100 to expand said liner 100 and a final state corresponding to FIG. 5, wherein the connection between the inner volume 202 of the casing 200 and the inner volume 102 of the liner 100 is interrupted, while a connection is established between the inner volume 102 of the liner 100 and an annular volume EA1 of the well P outside of the liner 100 and of the casing 200, so as to avoid the collapse of the membrane composing the liner 100, particularly under the pressure of the annular volume EA1. In fact, the inner volume 102 of the liner 100 being subjected to the same pressure as the annular volume EA1, the liner 100 is not affected by possible changes in pressure in the annular volume EA1.

An assembly 300 is noted in FIG. 6 conforming to a first variant embodiment of the present invention comprising in combination a three-way, two position valve 500 and an input non-return valve 400.

The non-return valve 400 is placed in a pipe coming from the inner volume 202 of the casing 200 and leading to a first path 502 of the valve 500. It comprises a body which defines a conical seat 410 tapered moving away from the input coming from the inner volume 202 of the casing 200, a closure member 420 placed downstream of the seat 410 with respect to a fluid feed direction extending from the inner volume 202 of the casing 200 toward the inner volume 102 of the liner 100 and a spring 430 which drives the closure member 420 into sealing contact against the seat 410 and thereby which biases the valve 400 to closure.

The seat 410 and the closure member 420 are advantageously made of metal defining a metal/metal valve 400 with sealing means.

At rest the valve 400 is closed under the bias of the spring 430. When the pressure exerted from upstream to downstream by a fluid, applied from the inner volume 202 of the casing 200, exceeds the setting force exerted by the spring 430, this pressure presses back the closure member 420 and opens the valve 400. On the other hand, any pressure exerted from downstream to upstream, i.e. from the inner volume 102 of the liner 100, tends to reinforce the bias of the closure member 420 against its seat and therefore the valve 300 to closure.

The two other paths 504 and 506 of the valve 500 are connected respectively with the inner volume 102 of the liner 100 and the annular volume EA1 of the well P.

In the initial state shown in FIG. 6, the valve 500 provides a connection between the paths 502 and 504 and consequently between the output of the valve 400, i.e. the inner volume 202 of the casing 200, when the valve 400 is open, and the inner volume 102 of the liner 100.

In the final switched state shown in FIG. 7, the valve 500 provides a connection between the paths 504 and 506. The connection between the output of the valve 400 and the inner volume 102 of the liner 100 is interrupted and a connection is established between the inner volume 102 of the liner 100 and the annular volume EA1 of the well.

As will be described in more detail hereafter, the final state shown in FIG. 7 is obtained after breaking of a disc 920 associated with the piston of the spool 500. It will be observed that the pressure applied from the non-return valve 400 remains in the inner volume 102 of the liner 100 until breaking or degradation of the pin 590.

As indicated previously, the valve 500 comprises a piston adapted to define in the final switched state a second valve 510 with a direction opposite that of the valve 400, on the passage running from the inner volume 202 of the casing 200 to the inner volume 102 of the liner 100. The equivalent schematic of the assembly 300 thus obtained in the final switched state is shown in FIG. 8. In this FIG. 8 the valve 510 has been shown schematically comprising a body which defines a conical seat 512 tapered when approaching the input coming from the inner volume 202 of the casing 200, a closure member 514 placed upstream of the seat 512 with respect to a fluid feeding direction running from the inner volume 202 of the casing 200 toward the inner volume 102 of the liner 100 and a spring 516 which biases the closure member 514 into sealed contact with the seat 512 and thereby which biases the valve 510 to closure.

The seat 512 and the closure member 514 are advantageously made of metal, defining a metal/metal valve 500 with sealing means.

In the initial state of the valve 500, the valve 510 is open. During the switching of the valve 500 after breaking of the disc 920, the valve 510 closes under the biasing from the spring 516. The assembly then comprises two valves 400 and 510 with opposite directions, back to back, which prevent any circulation of fluid in any direction between the inner volume 202 of the casing 200 and the inner volume 102 of the liner 100.

The three-way valve 500 can be subject to numerous modes of implementation. It preferably comprises a piston 550 equipped with and/or associated with a closure member 514 made of metal mounted with the ability to translate within a body 310 made of metal of the assembly. More precisely, the piston 550 is translatably mounted in a chamber 320 of the body 310 into which lead pipes corresponding to the paths 502, 504 and 506 and are connected respectively to the inner volume 202 of the casing 200, to the inner volume 102 of the liner 100 and to the inner volume EA1 of the well P.

In the remainder of the description of the concept, the term "body 310" must be understood without any limitation whatsoever, the body 310 comprising the whole of the housing which houses the functional elements of the three-way valve 500 and, if appropriate, of the input valve 400, and possibly composed of several parts.

The chamber 320 and the piston 550 are stepped and the pipes 502 and 504 lead into locations distributed longitudinally in the inner chamber 320. The pipe 506 is, for its part, located axially in the channel 340, in the extension of the chamber 320.

The valves 400 and 510 have been previously described, the seats 410, 512 whereof, and the closure member 420, 514 are advantageously made of metal, thus defining the valves 400, 510 as metal/metal with a seal 470, 570.

The sealing means allow a reduction of any risk of loss of sealing between such a metal closure member and its associated metal seat. For example, these additional sealing means consist of an O-ring seal (or any equivalent means, for example an O-ring associated with a ring) adapted to rest on a complementary bearing when the valve is in its closing position or near its closing position. Thus the valve 400 and/or 510 is and remains sealed even if the closure member 420 or 514 is not resting perfectly against its associated seat 410 or 512, for example in the event that the fluid conveyed is not correctly filtered.

Such an additional seal 470, 570 is provided by the closure member and is adapted to come into contact against a complementary bearing formed on the body housing the valve and forming the seat, when the valve is in its closing position or near its closing position. The seal can, as a variant, be provided on the body housing the valve and forming the seat, and then be adapted to come into contact with a complementary bearing formed on the closure member, when the valve is in its closing position or near its closing position.

In one embodiment, an additional seal 570 is mounted in a groove formed on the closure member 514. This seal 570 is adapted to come into contact against a complementary bearing 511 formed at a cut-out on the body 310 housing the valve 510, aligned with and upstream of the seat 512. The diameter of the cut-out which forms the bearing 511 is, on the other hand, slightly smaller than the outer diameter at rest of the seal 570 to ensure the aforementioned sealing effect.

It will be noted that, preferably, the travel of the closure member 514 is such that in the initial position, the seal 570 is placed beyond the input pipe 316 so as not to perturb the flow of fluid providing for inflation of the liner 100. In other words, the pipe 316 is located, in the initial position, between the seal 570 and the bearing 511.

According to another advantageous feature of the present invention, the input valve 400 and the valve 500 are preferably formed in distinct parallel longitudinal channels formed in the body 310 of the assembly 300 parallel to the longitudinal axis of the casing 200, the aforementioned longitudinal channels being connected by transverse pipes.

The embodiment illustrated in FIGS. 9 to 12 which correspond to a first embodiment of an assembly 300 conforming to the present invention will now be described, comprising a device 500 forming a three-way valve held initially by releasable immobilization means 900 and comprising, in the switched state, two opposite valves back to back, 400 and 510.

In the remainder of the description, the terms "upstream" and "downstream" will be used with reference to the direction of displacement of a fluid from the inner volume 202 of the casing 200 to the inner volume 102 of the liner 100.

According to this first example, the assembly 300 comprises, in the body 310, two mutually parallel longitudinal channels 330 and 340 parallel to the axis O-O of the casing 200. The channels 330 and 340 are located in different radial planes. The channel 330 houses the input valve 400. The channel 340 houses the three-way valve 500.

The longitudinal channel 330 communicates with the inner volume 202 of the casing 200, at a first axial end, through a radial channel 312 closed at its radially outward end by a stopper 314.

In proximity to its second axial end which receives the non-return valve 400, the longitudinal channel 330 communicates with the second longitudinal channel 340 through a transverse passage 380.

The longitudinal channel 340 has a second transverse passage (pipe) 318 which communicates with the inner volume 102 of the liner and an opening 350 which leads axially outward to the annular volume EA1 of the well.

In practice, communication with the annular space EA1 is accomplished by a plurality of radial openings in the longitudinal channel 340 beyond the opening 350.

The passage 380, the passage 318 and the opening 350 form respectively the three paths 502, 504 and 506 of the valve 500.

The first longitudinal channel 330 has a conical zone 410 which diverges going away from the first end connected to the input radial channel 312 and which forms the aforementioned seat of the valve 400. This conical zone 410 is located upstream of the pipe 316.

As can be seen in FIG. 9, the channel 330 houses, facing this seat 410, a closure member 420 including a complementary conical end urged to press against the seat 410 by a spring 430.

As described previously with respect to FIGS. 6 to 8, such a valve 400 is closed when at rest and opens when, the valve 500 allowing passage between the inner volume 202 of the casing 200 and the inner volume 102 of the liner 100, the pressure exerted on the closure member 420 by the fluid present in the casing 200 exceeds the force of the spring 430.

The second longitudinal channel 340 has a conical zone 512 located axially between pipe 316 and passage 318. The zone 512 diverges when approaching the first pipe 316 and forms the aforementioned seat of the valve 510.

As can be seen in FIGS. 10 to 12, the channel 340 houses a piston 550 and a closure member 514 capable of translation.

The closure member 514 is placed upstream of the piston 550 and rests on the upstream end 556 of the piston 550. It has, facing the seat 512, a conical zone complementing the seat 512. The closure member 514 is urged to press against the seat 512 by a spring 516.

The diameter of the piston 550 is less than the diameter of the smallest section of the zone 512 which forms the seat of the valve 510, so that the fluid can freely invade the chamber 320. All the annular space around the piston 550 bathes in the fluid, which means that the chamber 320 is at the fluid pressure.

It is thus noted that, in the initial position, the pressure in the chamber 320 is equal to the pressure in the liner 100.

In other words, it is important that, in the initial state there is absolutely no sealing effect between pipe 316 and passage 318 and the end of the chamber 320 where the releasable immobilization means 900 are located, so that the fluid can penetrate all of said chamber 320.

At rest, however, in the initial position, the conical closure member 514 is held away from the seat 512 by the piston 550 and the immobilization means 900 placed in the bottom of the channel 340 facing one end 552 of the piston 550 aligned axially with the piston downstream of the closure member 514. The piston 550 is resting on said releasable immobilization means 900.

The closure member 514 is mounted movable in translation and is therefore, in the initial state, in contact with the end 554 opposite to the end 552 of the piston 550, which in turn is in contact with said immobilization means 900 in the initial position.

The immobilization means 900 take the form of a valve 910 inserted between the chamber 320 and the opening 350 in communication with the annular volume EA1. In the initial state, a breaking disc 920 prevents any fluid communication between the chamber 320 and the opening 350. In other words, said immobilization means 900 close the connection between the chamber 320 and communication to the opening 350.

In FIGS. 10 to 13, the assembly 300 comprises the housing 310 and a sub-part 319 wherein are comprised the immobilization means 900. The housing 310 and the sub-part 319 can nevertheless consist of a single part. The division into two independent parts is convention for reasons of manufacture of the assembly. A seal 319*a* can be placed between the sub-part 319 and the housing 310 to prevent any leakage of fluid from the chamber 320 between the subpart 319 and the housing 310.

As mentioned previously, the term body 310 will hereafter be employed as a generic term to designate a block or a block composed of several sub-parts.

Under the influence of the pressure of the fluid prevailing in the chamber 320, the releasing means 900 can break and open, thus releasing the piston 550 in the process and consequently also releasing the closure member 514 which can now close the pipe 502. In practice, it is necessary to take into account the pressure in the opening 350 toward to the annular space EA1, as well as the force exerted by the piston 550 on said means 900 due to the force exerted by the spring 516 on the closure member.

It is thus possible to define a threshold pressure difference ΔPs at which said means 900 break. Such a pressure difference ΔPs depends for example on the size of the breaking disc 920 and the effective surface area that it offers the fluid in the chamber 320. Given the value of the pressure in the chamber 320, it is possible to neglect the force due to the piston 550 which is pushed by the spring 516.

In particular, the higher the effective surface area of the disc 920, the more the forces connected with the thrust on the piston 550 from the spring 516 will be negligible.

After breaking under the joint effect of the pressure differential between the inner pressure of the liner 100 and the pressure of the annular volume EA1 and the spring 560, the immobilization means 900 are open, which opens the connection with the opening 350 and the piston 550 is no longer held in its initial position. Consequently, the spring 516 causes the piston 550 to undergo translation by means of the immobilization means 900 by means of the closure member 514, and the latter can from now be pressed by said spring 516 against its seat 512, thus closing the pipe 316.

After releasing the means 900, the piston 550 does not play any particular role and can, depending on the movements of the fluid, come back into contact with the closure member 514 or come into contact with the immobilization means 900 which have been broken (see FIG. 12).

Whatever its position, said piston 550 does not isolate any portion of the chamber 320 from another, nor does it prevent any flow of fluid, because its diameter is less than the different cross-section diameters of the chamber 320, comprising the seat 512.

Inasmuch as the connection established in the final state between the passage 318 which communicates with the inner volume 102 of the liner and the opening 350 which communicates with the outer annular volume EA1 serves to equalize pressure, the movements of fluid between these two volumes are small, and if they occur, the flow rate is low and/or slow.

The immobilization means 900, and in particular the breaking disc 920, thus have a dual function:

- The first is to hold in the initial position the piston 550 which in turn allows the closure member 514 to be held in the open position,
- The second is to prevent, respectively allow, communication between the inner volume 102 of the liner 100 (via the chamber 320) and the outside in the annular volume EA1 of the well (via the opening 350), in the initial state, respectively in the final state once a certain pressure is attained in the chamber 320.

These two functions are interdependent, inasmuch as when the closure member 514 is held in the open position, communication toward the outside through the opening 350 is not allowed, and when the closure member 514 is no longer held in the open position, communication toward the outside through the opening 350 is allowed.

In comparison to embodiments using breaking pins placed transversely, this technique allows better control and better precision in the breaking value, as well as greater reliability. In fact, it is essentially the pressure exerted by the fluid in the chamber 320 which causes the breaking of the breaking disc 920. However, the forces induced by a fluid pressure are more easily calculated and predictable than the shearing forces in the pins, said forces being exerted by the displacement of the part wherein is inserted the breaking pin.

In addition, there exists a breaking disc industry which has extended knowledge of breaking prediction, unlike the pins which are generally of inner manufacture.

As mentioned previously, the greater the effective surface area of the breaking disc 920, i.e. the greater the surface on which the pressure is able to exert an uncompensated force on the disc, the greater the reliability of the immobilization means 900 will be with respect to the piston 550 which exerts a force on the spring 516.

The person skilled in the art will understand that according to all the embodiments conforming to the invention, the isolation system integrates a three-way valve 500 including a single switching piston 550 so that:

During a setting up phase of the annular isolation system in a well, the system is in communication with the inside of the casing 200 such that the pressures are balanced between the inside of the lining 100 and the inside of the casing 200. On the other hand, there is not possible communication between the inner volume 102 of the liner 100 and the annular space EA1 or EA2 or between the casing 200 and the annular space EA1 or EA2.

During an inflation phase, the inner volume 102 of the liner 100 is in communication with the inside of the casing 200. Thus, when the pressure increases in the casing 200, the pressure increases likewise in the liner 100. On the other hand, there is no possible communication between the inner volume 102 of the liner 100 and the annular space EA1 or between the casing 200 and the annular space EA1.

At the conclusion of inflation, the movement of the piston 550 is released by the breaking of the immobilization means 900 caused by the increase in the pressure differential which makes it possible to inflate the system. The breaking of the immobilization means 900 definitively releases the movement of the piston 550 and closes communication between the casing 200 and the inner volume 102 of the liner 100, and opens at the same time communication between the inner volume 102 of the liner 100 and the annular volume EA1. After breaking of said means 900, it is no longer possible to inflate the isolation system from the casing.

The valve 500 is constituted in such a fashion that the reverse movement of the piston 550 plays no part even if a pressure differential, positive or negative, exists between the annular space EA1 and the inside of the casing 200.

When a pressure differential is applied from EA1 to EA2 such that $P_{EA1}>P_{EA2}$, the fluid, and hence the pressure, communicates inside the expandable liner 100 through passage 318 and opening 350 of the valve 500. The inner pressure of the expandable membrane 100 is identical to the pressure in the annular zone EA1, which confers on it excellent zone isolation properties.

If the annular pressure varies over time and can be alternatively: pressure of EA1>pressure of EA2 or pressure of EA2>pressure of EA1, mounting two zone isolation systems head-to-tail can be mounted as illustrated in FIG. 13.

Of course, the present invention is not limited to the embodiments which have just been described, but extends to any variant conforming to its spirit.

The valves 400 and 510 have been described previously the seat whereof 410, 512 and the closure member 420, 514 are advantageously made of metal thus defining metal/metal valves 400, 510.

As indicated at the beginning of the description, the device 500 can be used within a larger scope.

In particular, in one embodiment the valve 500 is independent of the non-return valve 400 and consists of a three-way valve in which, in the initial state, a communication between the inside of the casing and the inside of the liner is allowed by immobilization means 900 which hold the closure member in the open position and, in the final state, communication toward the outside annular volume is allowed thanks to the opening of the opening 350 following the breaking of the immobilization means 900.

The invention is not limited to a closure member 540 held in the closing position by the spring 560. In fact, it is possible to provide, in an architecture other than that previously presented, that the closure member 540 is free in its translations depending on the pressures in the pipes, so that they can be alternately open or closed even when the immobilization means 900 are in the final position.

The measuring system 1000 allows measurement of the longitudinal displacement of the piston 550 inside the chamber 320.

To this end, said system 1000 comprises

Figure 1:
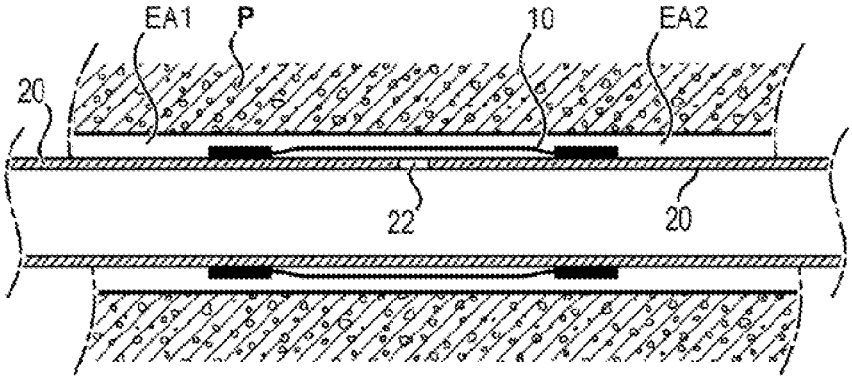
FIG. 1 Prior art
Figure 2:
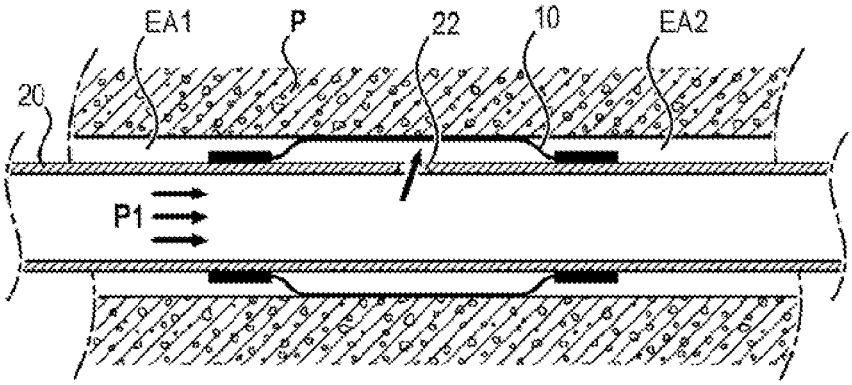
FIG. 2 Prior art
Figure 3:
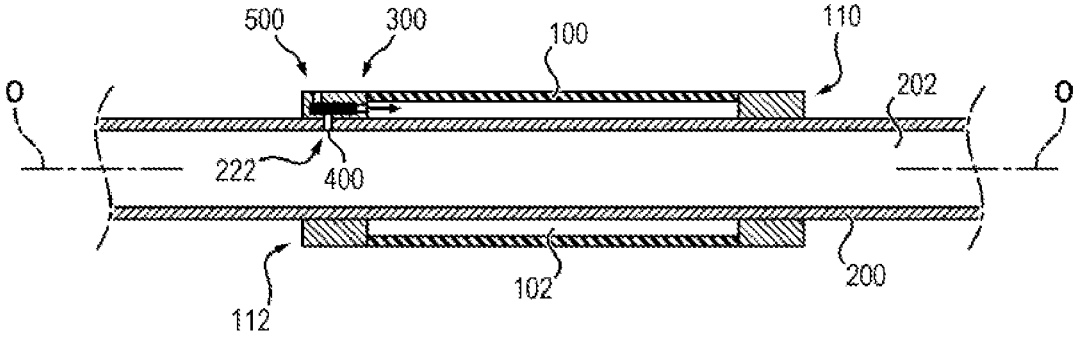
Figure 4:
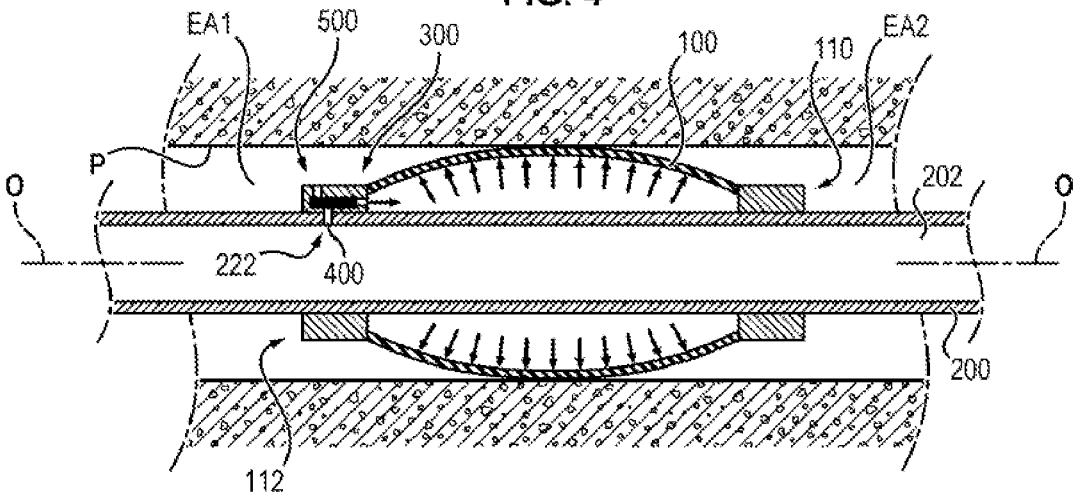
Figure 5:
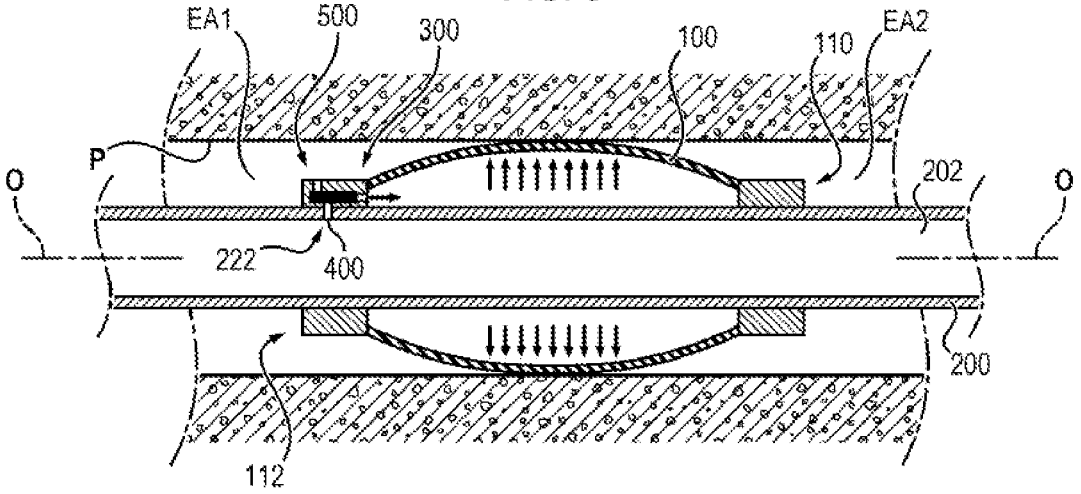
Figure 6:
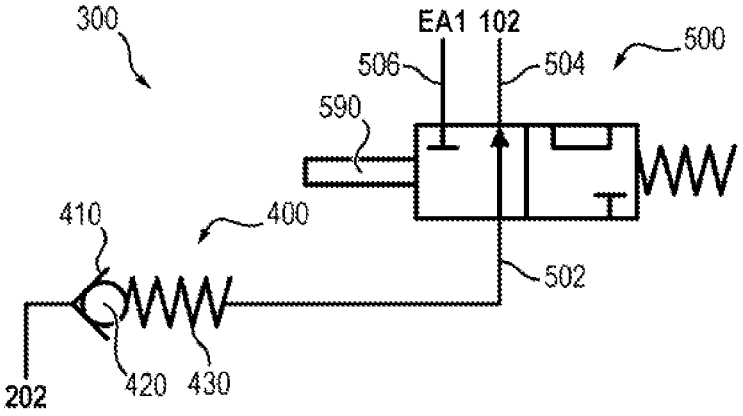
Figure 7:
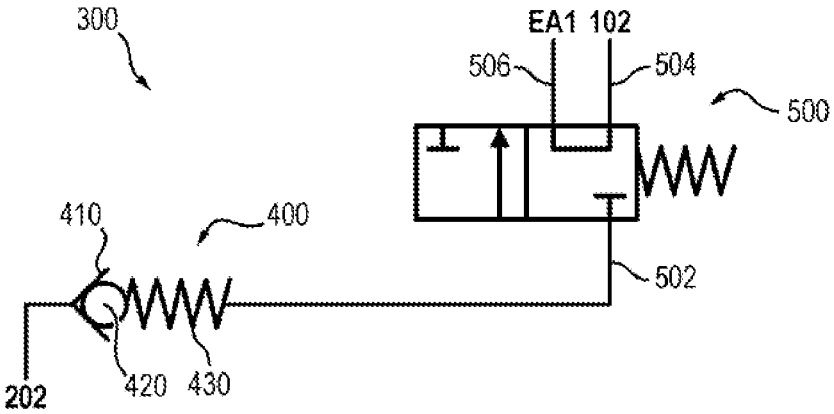
Figure 8:
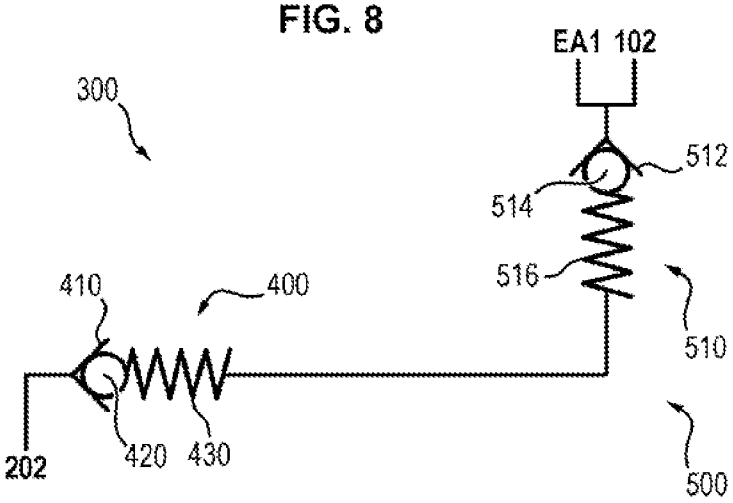
Figure 9:
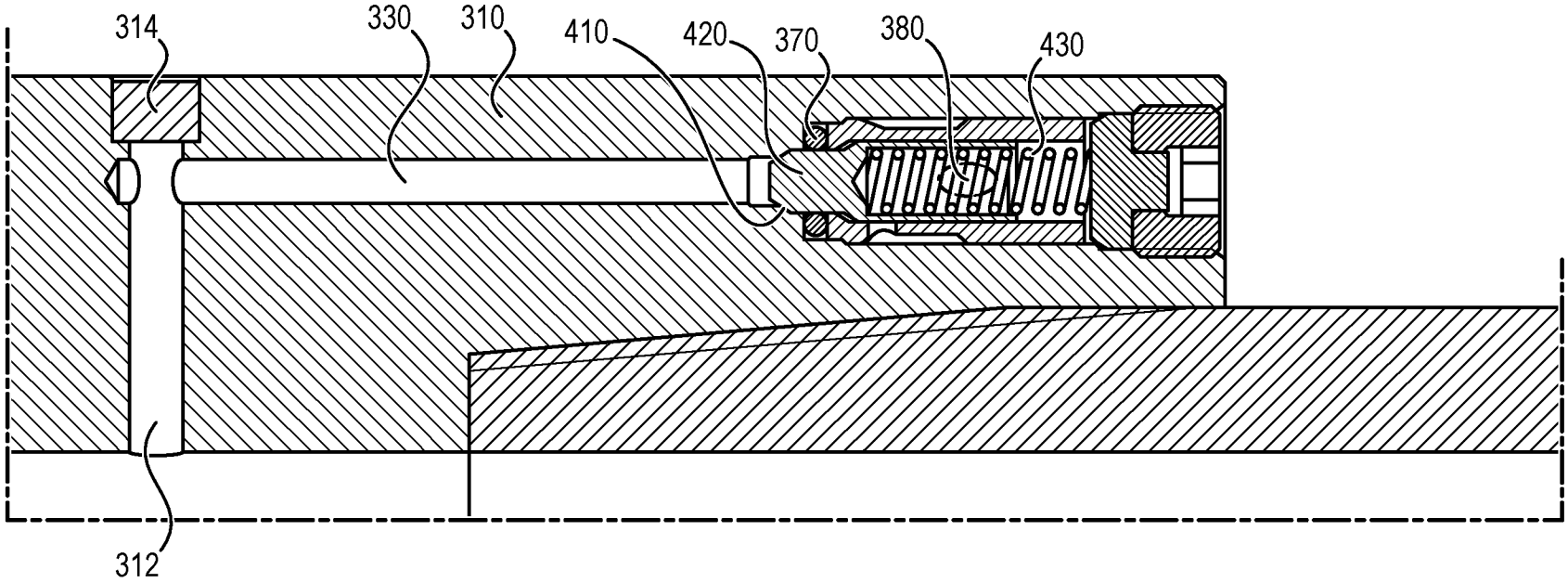
Figure 10:
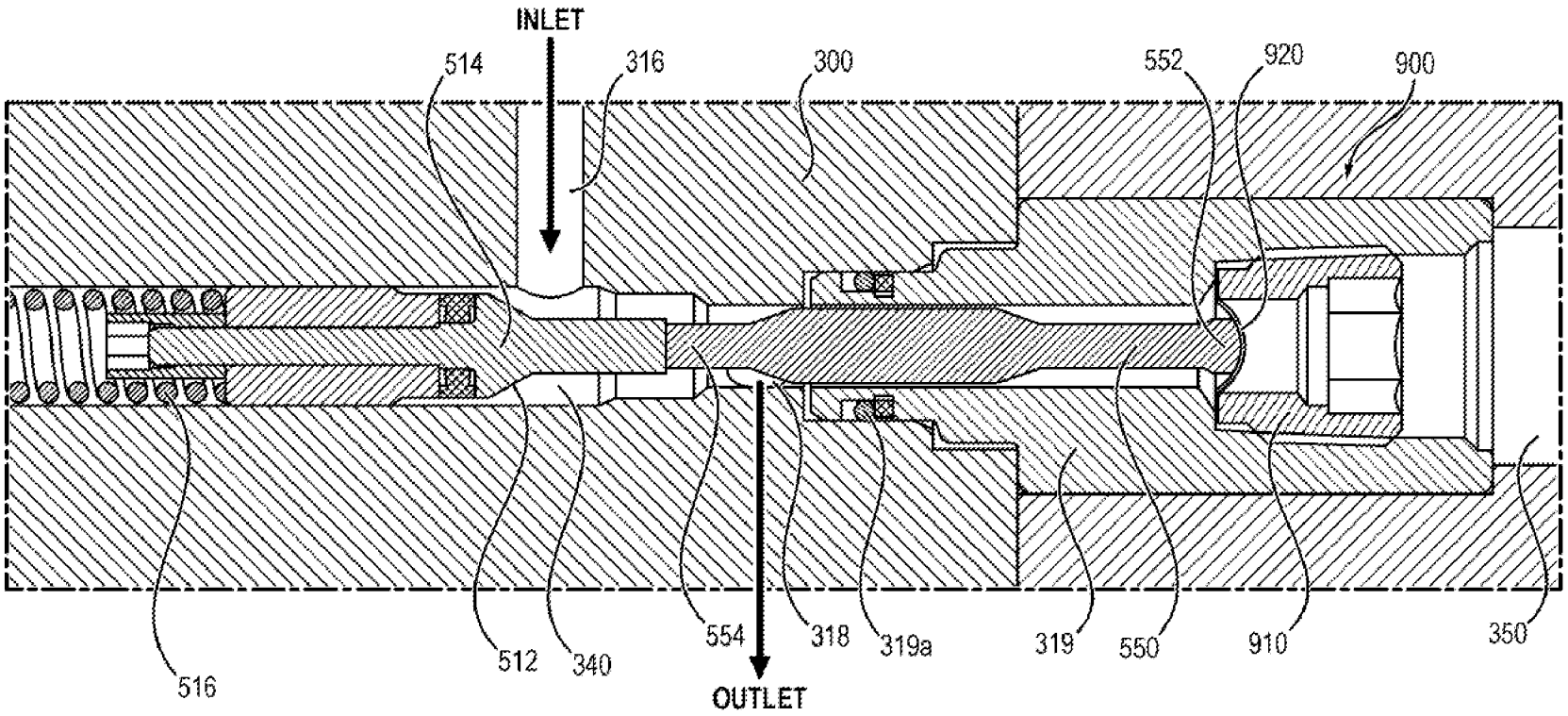
Figure 11:
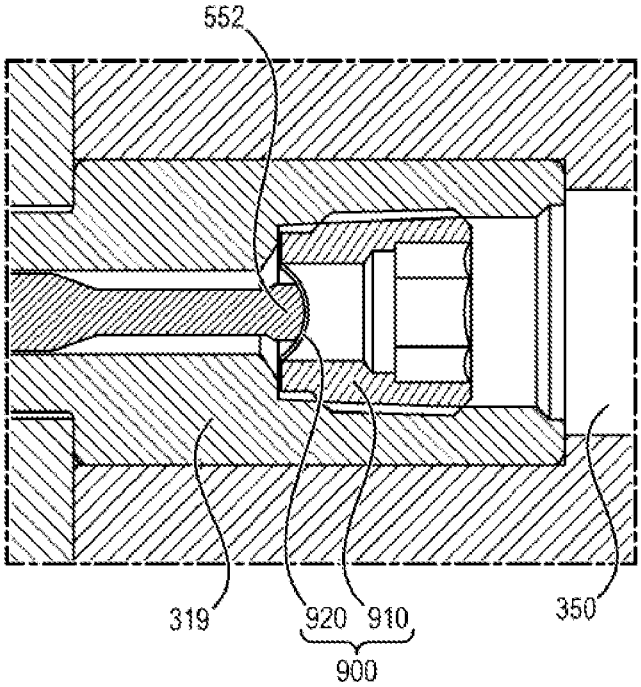
Figure 12:
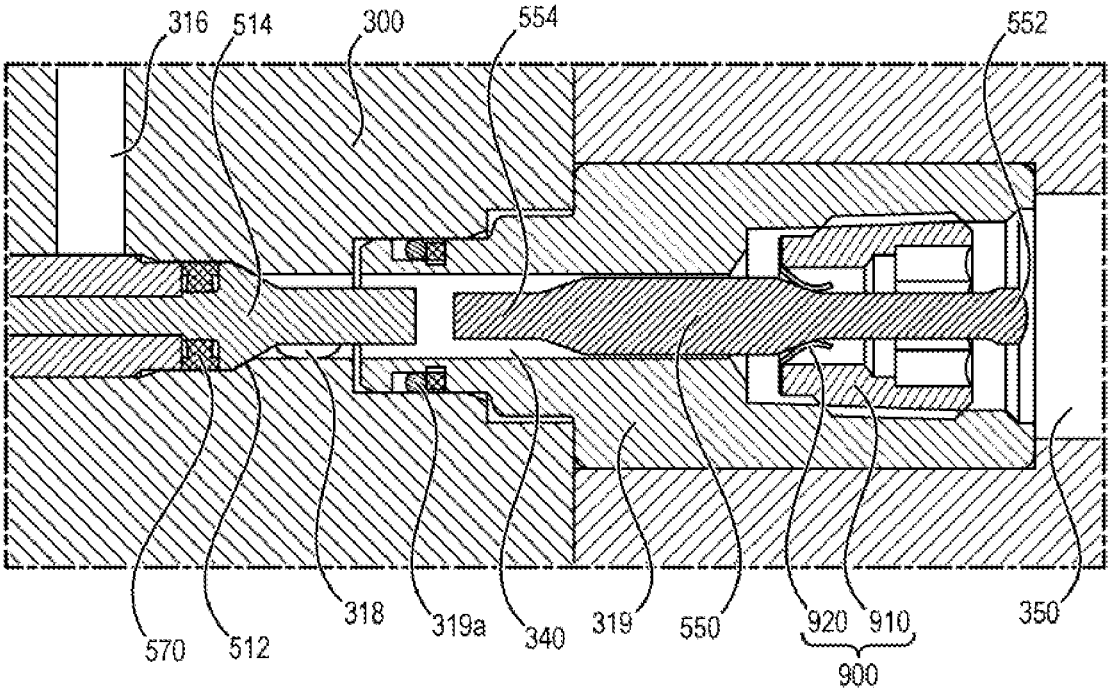
Figure 13:
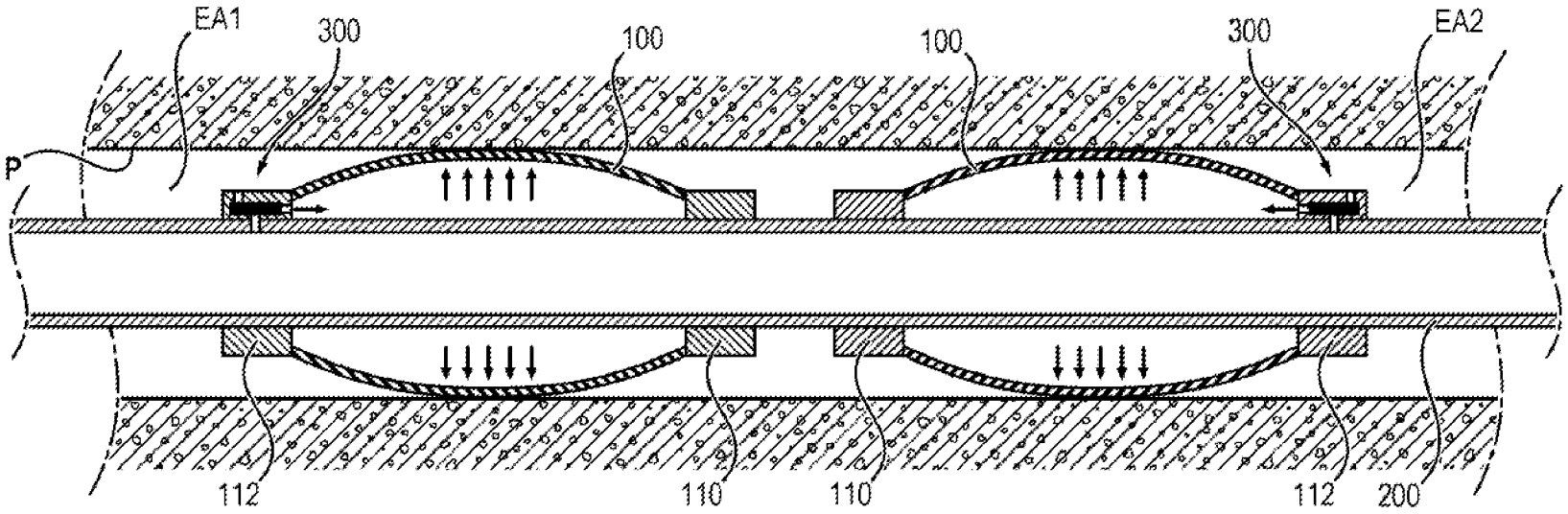
Figure 14:
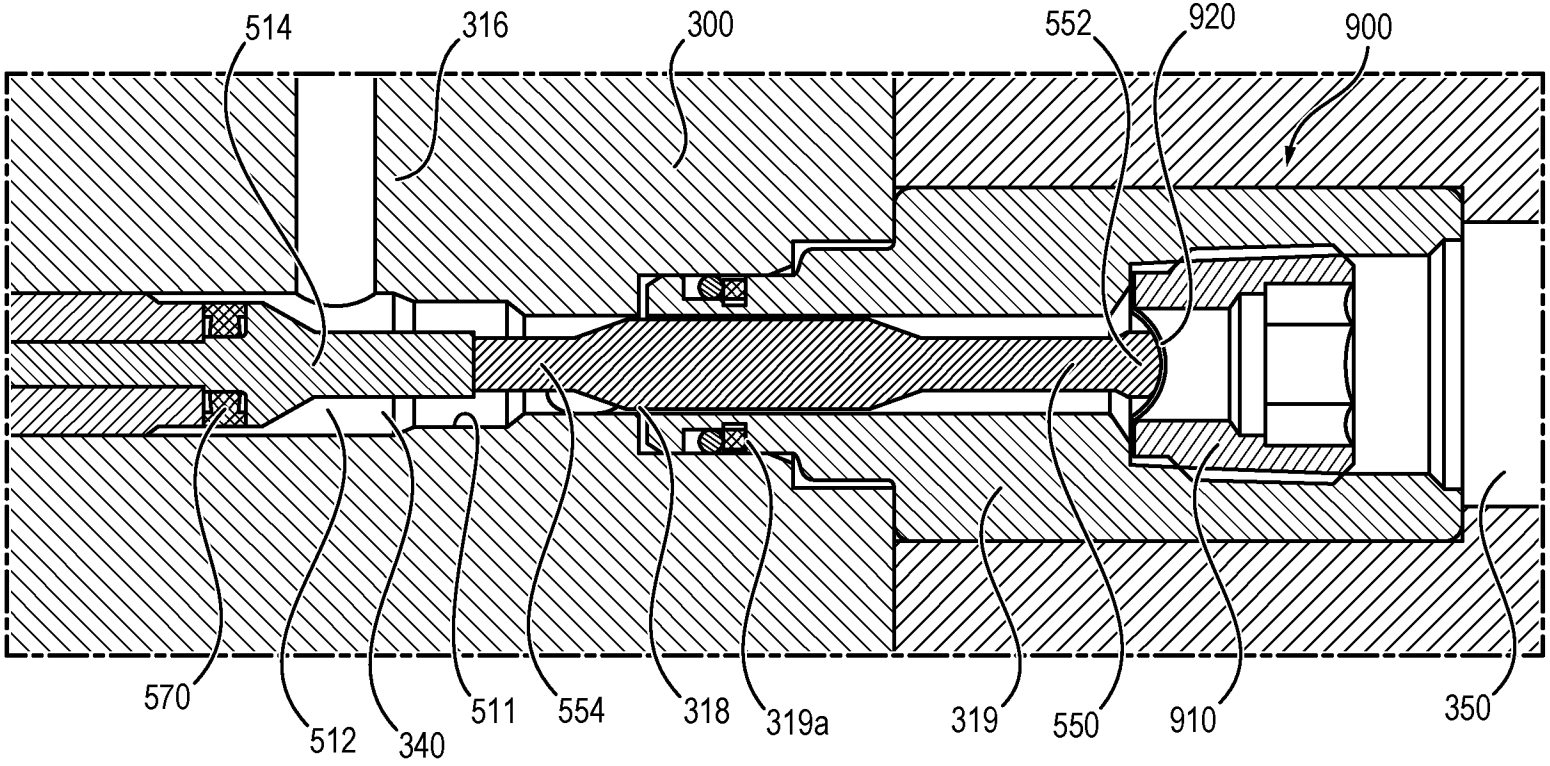
FIGS. 14 to 16 show a device without the spring 560.
Figure 15:
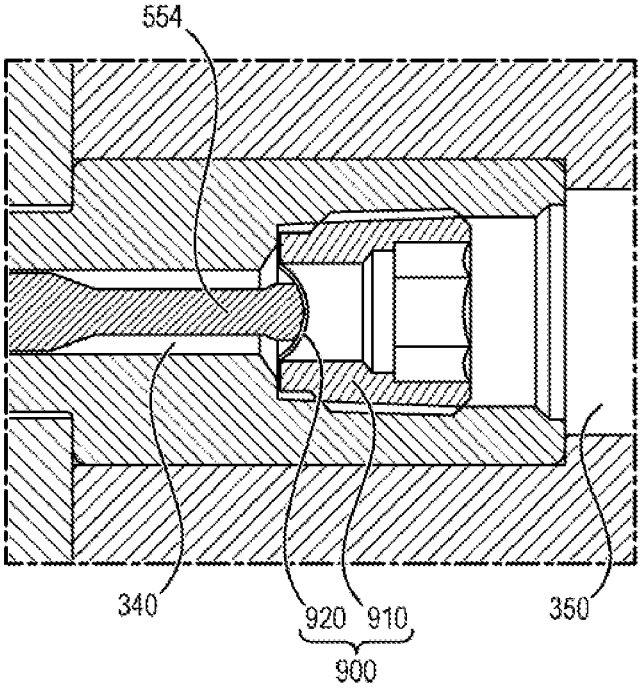
Figure 16:
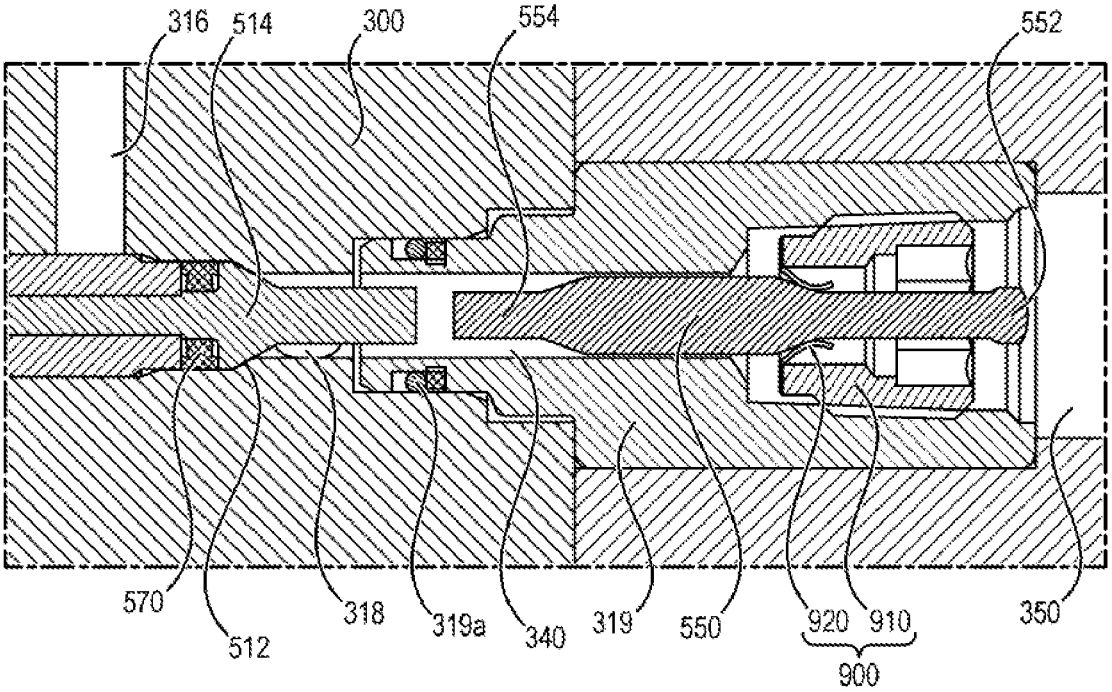
Figure 17:
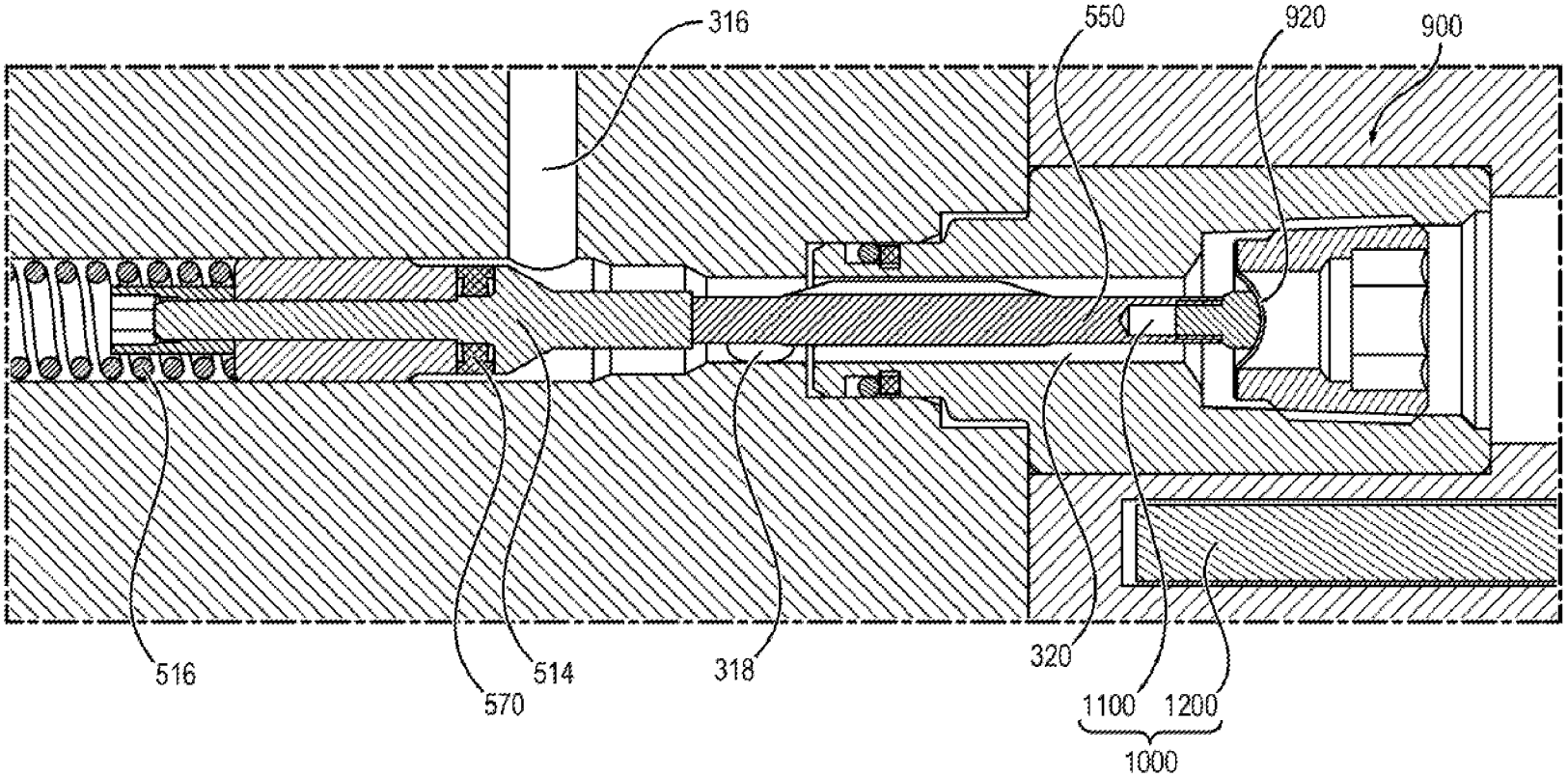
FIGS. 17 and 18 show a measurement system 1000 implemented in the device and intended to evaluate the position or the state of the device 500 (first position, initial state, second position, final state). This system can be implemented in all the embodiments.
Figure 18:
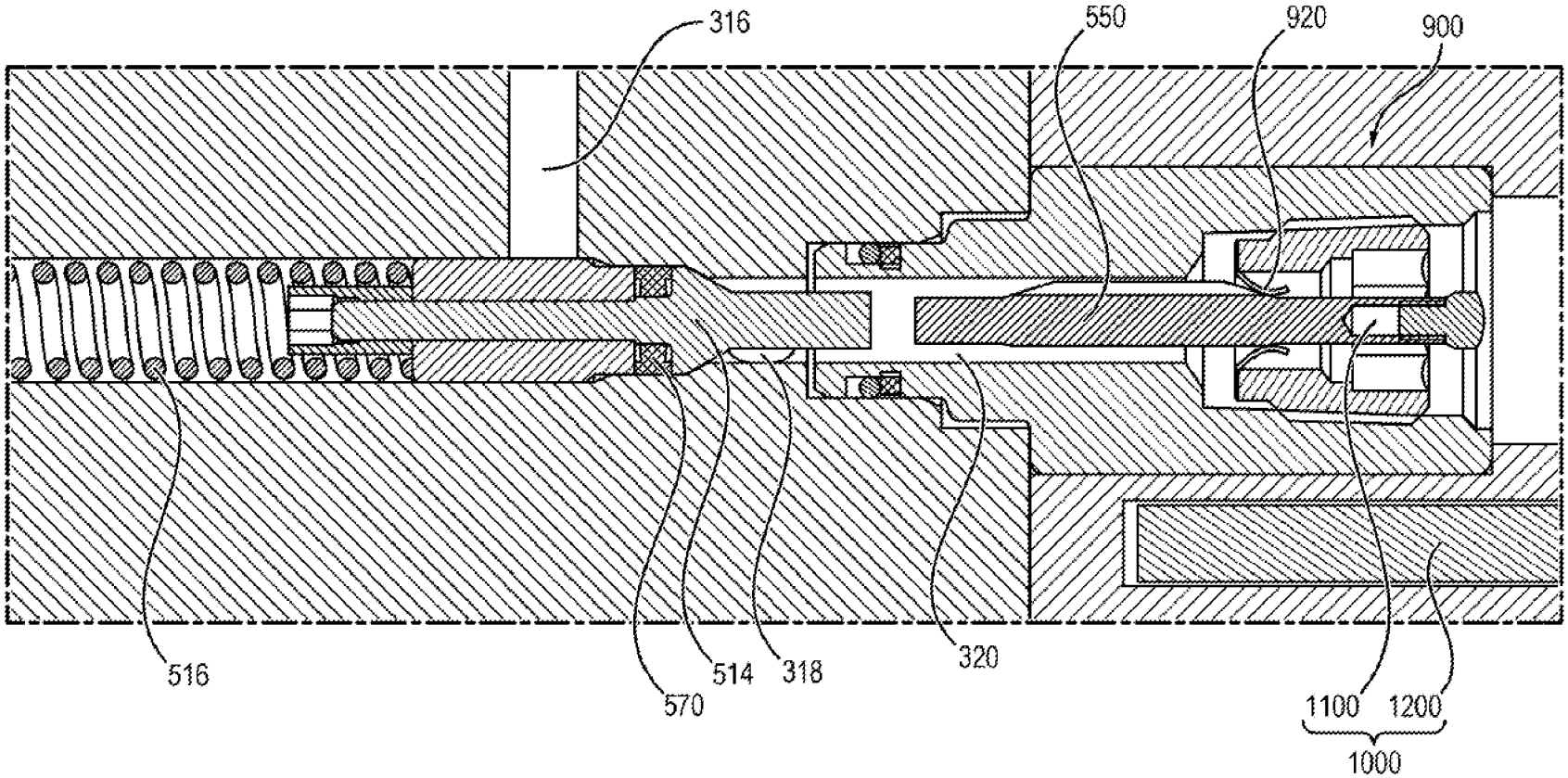

- a magnet 1100 placed inside the piston 550. Preferably and as shown in FIGS. 17 and 18, for positioning reasons, the magnet 1100 is located at the end 552, i.e. the end which is in contact with the breaking means 900 in the initial state,
- a sensor 1200, placed in the housing 310 surrounding the piston 550 and configured to acquire the longitudinal position (or abscissa) of the magnet 1100, and thus to know the longitudinal position of the piston 550. In FIGS. 17 and 18, the sensor extends substantially along the breaking means 900 so as to be able to acquire the position of the magnet 1100 when the piston 550 passes through the breaking disc 920.

In FIG. 17, the device 500 is in the initial state, i.e. the breaking means 900 have not broken.

In FIG. 18, the device 500 is in the final state, i.e. the breaking means 900 have broken. The sensor 1200 has thus detected a longitudinal displacement of the magnet 1100 indicating that the device is in the final state.

The measuring system 1000 thus makes it possible to know if the disc 920 has broken, and therefore if the connection between the inner volume 102 of the liner 100 and the annular space EA1 outside the casing is allowed and therefore, particularly in the presence of the spring 516, whether the closure member 514 is on its seat and closes the pipe 316 associated with the inside of the casing.

By way of an example, the displacement of the piston 550 is 15 mm between the two states.

The recovery of the sensor data is accomplished by means of a tool (called a "wireline") held by a cable, which is lowered into the well (not shown in the figures). If necessary, the tool is associated with a tractor which allows displacement of the tool in the horizontal portions.

The cable has a mechanical role (for dropping and raising the tool) and an electronic one (for transmitting the data and controlling the tool/the tractor).

Transmission of data from the measuring system 1000 is accomplished wirelessly.

The invention claimed is:

1. A fluid control device for treating a well, comprising an expandable liner placed on a casing and an assembly adapted to control the feeding of the inner volume of the liner using a fluid under pressure coming from the casing through a passage passing through the wall of the casing, to expand the liner radially outward, the assembly comprising a valve, said valve comprising:

- a body which defines a chamber into which lead
- a first pipe which communicates with the inside of the casing,
- a second pipe which communicates with the inside of the expandable liner, and
- a third pipe which communicates with the annular space located outside the casing, said third pipe being located in an extension of the chamber,
- a piston translatably mounted in said chamber and
- a breakable disc positioned at an opening of said third pipe into said chamber such that the breakable disc separates the third pipe from the chamber, the breakable disc being capable of rupturing, on which, in an initial state, one end of said piston comes into abutment and which, in an initial position, closes said third pipe, said breakable disc being releasable under the influence of the fluid pressure in said chamber when it is equal to the fluid pressure in the liner,
- a closure member translatably mounted in said chamber, configured to open or close said first pipe, said closure member being, in the initial state, in contact with another end of the piston which holds the closure member in the open position,
- so that, in the initial state, said piston allows only communication between said first and said second pipes,
- then, after breaking of said breakable disc, said piston is released in translation,
- so that, in the final state said third pipe is open and said closure member is no longer held in the open position by the piston.

2. The device according to claim 1, further comprising a spring which biases said closure member into the closing position to close said first pipe with the inside of the casing when the breakable disc is broken.

3. The device according to claim 1, further comprising a measuring system configured to measure the position of said piston in said chamber, so that it is possible to know the state of the device.

4. The device according to claim 3, wherein the measuring system comprises a magnet located in said piston and a sensor located in said housing, said sensor being capable of measuring a displacement of said magnet.

5. An isolation system for treating a well comprising a device according to claim 1,

- wherein said assembly of the device further comprises a non-return valve placed in a passage which connects the inner volume of the casing to the inner volume of the liner, said valve and said non-return valve forming, after switching, two valves mounted in series with opposite directions on the passage connecting said inner volumes of the casing and the liner.

6. The system according to claim 5, wherein said non-return valve placed in the passage which connects said inner volume of the casing to said inner volume of the liner is a valve biased elastically to closure, which opens under a fluid pressure which is exerted in the direction running from said inner volume of the casing to said inner volume of the liner.

7. The system according to claim 5, wherein said valves are non-return valves in which a metal closure member rests on a metal seat.

8. The system according to claim 5, wherein said valves are non-return valves with a conical seat.

9. The system according to claim 5, wherein said valves comprise a seal adapted to rest against a complementary bearing when said valve is in its closing position or near its closing position.

10. The system according to claim 9, wherein said seal is provided on said closure member and is adapted to rest against a complementary bearing formed on the body housing said valve and forming the seat, or is provided on the body housing said valve and forming the seat, and is adapted to rest against a complementary bearing formed on said closure member.

11. The system according to claim 5, wherein said non-return valve placed in the passage which connects said inner volume of the casing to said inner volume of the liner and the device are formed from two distinct sub-assemblies.

12. The system according to claim 5, wherein said non-return valve placed in the passage which connects said inner volume of the casing to said inner volume of the liner and the device are placed in distinct parallel longitudinal channels formed in the body of the assembly.

13. A method of isolating two annular zones of a well, implementing a step of feeding an expandable liner placed on a casing using a fluid under pressure coming from the casing, to expand the liner radially outward, the step of feeding the expandable liner comprising the steps of feeding the inner volume of the expandable liner by means of a non-return valve placed in a passage which connects the inner volume of the casing to the inner volume of the liner, then carrying out the switching of a system as defined by claim 5 between an initial state in which a connection is established between the inner volume of the casing and the inner volume of the liner to expand said liner and a final state in which the connection between the inner volume of the casing and the inner volume of the liner is interrupted and a connection is established between the inner volume of the liner and an annular volume of the well outside the liner and the casing, said device and said non-return valve forming, after switching, two valves mounted in series and with opposite directions on the passage connecting the inner volumes of the casing and the liner.

14. An assembly comprising, in combination, a non-return valve and a device conforming to claim 1 forming, after switching, two valves mounted in series and with opposite directions, back to back, on the passage connecting said inner volumes of a casing and a liner of a well isolation device.

15. The assembly according to claim 14, wherein said valves are non-return valves in which a metal closure member rests on a conical metal seat.

16. The device according to claim 1, wherein the closure member is separate from the piston.

17. A fluid control device for treating a well, comprising an expandable liner placed on a casing and an assembly adapted to control the feeding of the inner volume of the liner using a fluid under pressure coming from the casing through a passage passing through the wall of the casing, to expand the liner radially outward, the assembly comprising a valve, said valve comprising:

a body which defines a chamber into which lead a first pipe which communicates with the inside of the casing, a second pipe which communicates with the inside of the expandable liner, and a third pipe which communicates with the annular space located outside the casing, said third pipe being located in an extension of the chamber, a piston translatably mounted in said chamber and a breakable disc positioned at an opening of said third pipe into said chamber that is capable of rupturing, on which, in an initial state, one end of said piston comes into abutment and which, in an initial position, closes said third pipe, said breakable disc being releasable under the influence of the fluid pressure in said chamber when it is equal to the fluid pressure in the liner, a closure member, separate from the piston, translatably mounted in said chamber, configured to open or close said first pipe, said closure member being, in the initial state, in contact with another end of the piston which holds the closure member in the open position, so that, in the initial state, said piston allows only communication between said first and said second pipes, then, after breaking of said breakable disc, said piston is released in translation, so that, in the final state said third pipe is open and said closure member is no longer held in the open position by the piston.

18. The device according to claim 17, wherein a space exists between the piston and the closure member in the final state.

19. The device according to claim 17, further comprising a spring which biases said closure member into the closing position to close said first pipe with the inside of the casing when the breakable disc is broken.

20. The device according to claim 19, wherein the spring causes the closure member to press the piston against the breakable disc in the initial state.

* * * * *